US006514164B1

(12) United States Patent
Parrett

(10) Patent No.: US 6,514,164 B1
(45) Date of Patent: Feb. 4, 2003

(54) FOOTBALL APPARATUS

(76) Inventor: Robert E. Parrett, 15334 E. Thistle Dr., Fountain Hills, AZ (US) 85268

( * ) Notice: Subject to any disclaimer, the term of this patent is extended or adjusted under 35 U.S.C. 154(b) by 0 days.

(21) Appl. No.: 09/927,279

(22) Filed: Aug. 9, 2001

Related U.S. Application Data

(60) Provisional application No. 60/224,121, filed on Aug. 9, 2000.

(51) Int. Cl.[7] ..... A63B 41/00

(52) U.S. Cl. ..... 473/603; 473/596

(58) Field of Search ..... 473/596, 599, 473/603, 604, 605, 612, 594; 273/DIG. 29; 482/49

(56) References Cited

U.S. PATENT DOCUMENTS 2,761,684 A * 9/1956 Crowley et al. ..... 473/605
4,660,831 A * 4/1987 Kralik ..... 473/603
5,865,697 A * 2/1999 Molitor et al. ..... 473/604
6,022,283 A * 2/2000 Schindler et al. ..... 473/605
6,224,513 B1 * 5/2001 Chow ..... 473/601

* cited by examiner

*Primary Examiner*—Steven Wong
(74) *Attorney, Agent, or Firm*—Larry D. Johnson; Craig M. Stainbrook; Johnson & Stainbrook

(57) ABSTRACT

A football for recreational use includes an inner core portion consisting of an air bladder or foam material, which is at least partially surrounded by an internal web of raised threads. This inner core portion and surrounding web are then covered by a thin medial layer of deformable gel material, which is then covered by an external layer/outside covering of soft, pliable material. The web of internal threads surrounding the inner core, combined with the medial gel layer, enable the user's fingers and thumb to achieve a superior grip on the football, through the external layer, medial gel layer, and onto the threads, with minimal gripping force.

10 Claims, 1 Drawing Sheet

FOOTBALL APPARATUS

This application claims the benefit of U.S. Provisional Application Ser. No. 60/224,121, filed Aug. 9, 2000, by applicant herein.

BACKGROUND OF THE INVENTION

1. Field of the Invention

This invention relates generally to sporting goods and sports equipment, and more specifically to an improved football apparatus.

2. Description of the Prior Art

The game of football (or, more accurately, American-style football) is traditionally played with an inflated, oval ball having an internal air bladder and an exterior cover closed with laces. Unfortunately, it can be difficult to properly grip and throw a regulation football, particularly for beginners and/or those with small hands or weak hand grips.

Numerous modified footballs have been designed for non-professional and unofficial use. For example, some recreational and toy footballs have been constructed of soft foam material which is much easier for the casual user to grip. However, such recreational designs are typically significantly inferior to regulation footballs in their throwing distance and accuracy, ball catching and handling ability, control, and realism in use.

SUMMARY OF THE INVENTION

The football apparatus of this invention provides an improved football for recreational (i.e., non-professional, unofficial) use. The improved football includes an inner core portion consisting of an air bladder or foam material, which is at least partially surrounded by an internal web of raised threads. This inner core portion and surrounding web are then covered by a thin (e.g., one-quarter inch) medial layer of deformable gel material, which is then covered by an external layer/outside covering of soft leather (or leather-like material), rubber (or rubber-like material), or other soft, pliable material. Traditional laces, or faux laces, may be incorporated onto the outside covering for aesthetic and/or functional purposes. The web of internal threads surrounding the inner core (air bladder or foam), combined with the medial gel layer, enable the user's fingers and thumb to achieve a superior grip on the football, through the external layer, medial gel layer, and onto the threads, with minimal gripping force. This provides the user with an improved grip of the football, for better throwing distance and accuracy, better catching ability, and better ball handling, in wet or dry conditions, all while maintaining a realistic football appearance.

DETAILED DESCRIPTION OF A PREFERRED EMBODIMENT

Figure 1:
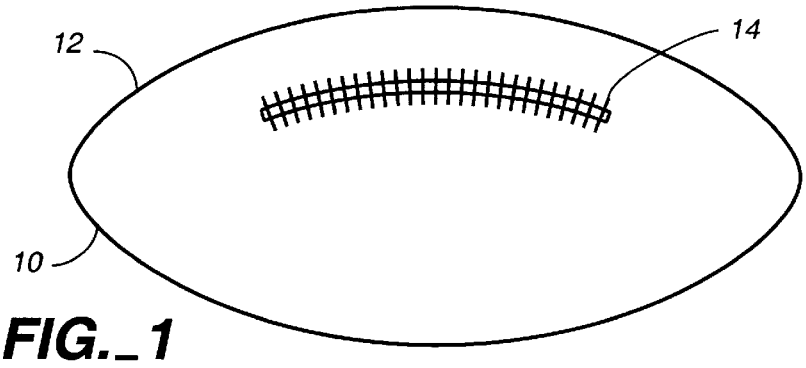
FIG. 1 is an elevation view of a football of this invention, illustrating the external features including a leather, rubber, or similar cover, and traditional laces for function and appearance.

FIG. 1 is an elevation view of a football 10 of this invention, illustrating the external features of the football including a leather, rubber, or similar material cover 12, and traditional laces 14 for function and appearance.

Figure 2:
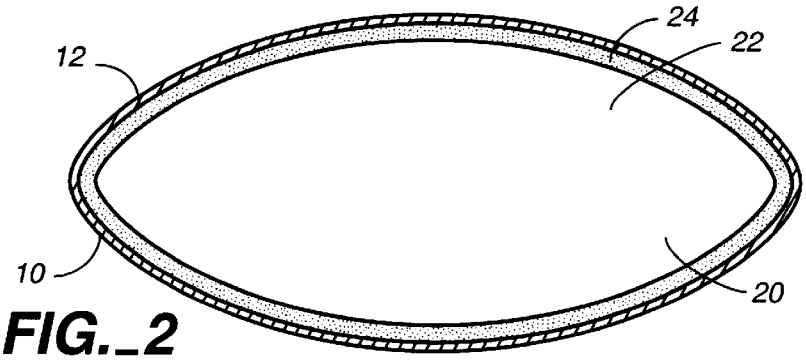
FIG. 2 is a cross-sectional view of one embodiment of the football of this invention, illustrating an inner core portion in the form of an air bladder, which is at least partially surrounded by an internal web of raised threads (not visible in this view), covered by a thin medial layer of deformable gel material, finally covered by the external layer/outside covering.

FIG. 2 is a cross-sectional view of one embodiment of the football 10 of this invention, illustrating an inner core portion 20 in the form of an air bladder 22, which is at least partially surrounded by an internal web of raised threads (not visible in this view), covered by a thin medial layer 24 of deformable gel material, and finally covered by the external layer/outside covering 12.

Figure 3:
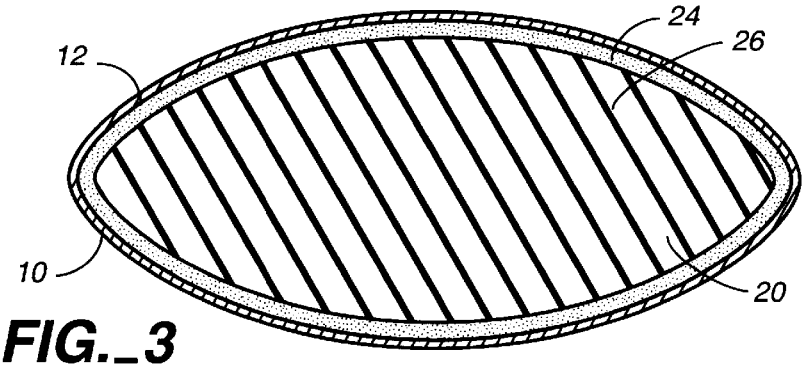
FIG. 3 is a cross-sectional view of an alternate embodiment of the football of this invention, illustrating an inner core portion in the form of a foam core, again at least partially surrounded by an internal web of raised threads (again not visible in this view), covered by a thin medial layer of deformable gel material, finally covered by the external layer/outside covering.

FIG. 3 is a cross-sectional view of an alternate embodiment of the football 10 of this invention, illustrating an inner core portion 20 this time in the form of a foam core 26, again at least partially surrounded by an internal web of raised threads (again not visible in this view), covered by a thin medial layer 24 of deformable gel material, and finally covered by the external layer/outside covering 12.

Figure 4:
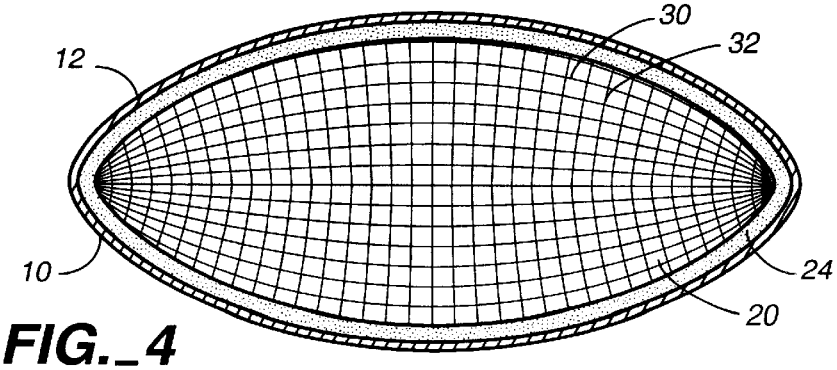
FIG. 4 is a partially cutaway view of the football of this invention, illustrating the internal web of raised threads surrounding the inner core portion.

FIG. 4 is a partially cutaway view of the football 10 of this invention, illustrating the internal web 30 of raised threads 32 surrounding the inner core portion 20, and beneath the medial gel layer 24. This medial gel layer may consist of a relatively thin layer (e.g., one-sixteenth to one-half inch thick, with one-quarter inch being preferable) of a plastic, deformable material such as silicone gel or other suitable substance, which enables the user's grip (i.e., fingers and thumb) to depress through the outside covering of the football and through the medial gel layer to the raised threads, giving the user sufficient grip or "purchase" on the football. The web of raised threads may consist of a regular, symmetric array of common thread, cord, nylon, or lace material, of sufficient diameter and of sufficient spacing between raised threads to provide a step or relief relative to the area adjacent or between the raised thread(s), again to the degree that would enable a user's grip to encounter and engage this relief. Alternatively, the web may be completely irregular and/or asymmetric, still providing the desired relief.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. A football apparatus comprising:

an inner core portion;

an internal web of raised threads at least partially surrounding said inner core portion;

a medial layer of deformable gel material covering said inner core portion and internal web of raised threads; and an outside covering.

2. The football apparatus of claim 1 wherein said inner core portion comprises an air bladder.

3. The football apparatus of claim 1 wherein said inner core portion comprises a foam core.

4. The football apparatus of claim 1 wherein said medial layer of deformable gel material comprises silicone gel.

5. The football apparatus of claim 1 wherein said medial layer of deformable gel material is approximately one-quarter inch thick.

6. The football apparatus of claim 1 wherein said outside covering comprises soft leather.

7. The football apparatus of claim 1 wherein said outside covering comprises rubber.

8. The football apparatus of claim 1 wherein said outside covering includes laces.

9. The football apparatus of claim 1 wherein said web of raised threads comprises a symmetric array.

10. The football apparatus of claim 1 wherein said web of raised threads comprises lace material.

* * * * *